US005409436A

United States Patent [19]

Chang

[11] Patent Number: 5,409,436

[45] Date of Patent: Apr. 25, 1995

[54] GRIPPER DEVICE

[76] Inventor: Sreter Chang, No. 451 Ta Tien Road, Homei Chen, Chang Hua Hsien, Taiwan, Prov. of China

[21] Appl. No.: 267,546

[22] Filed: Jun. 29, 1994

[51] Int. Cl.[6] ..... A63B 23/16

[52] U.S. Cl. ..... 482/49; 482/121; 482/128; 482/122

[58] Field of Search ..... 482/49, 50, 121, 122, 482/126, 128

[56] References Cited

U.S. PATENT DOCUMENTS

| | | | |
|---|---|---|---|
| 3,442,132 | 5/1969 | De Mare | 482/49 |
| 4,376,533 | 3/1983 | Kolbel | 482/128 |
| 4,480,832 | 11/1984 | Bulmash et al. | 482/122 |
| 4,513,962 | 4/1985 | Robson et al. | 482/49 |
| 4,634,114 | 1/1987 | Garcia | 482/49 |
| 4,726,580 | 2/1988 | Batiste et al. | 482/49 |

*Primary Examiner*—Richard J. Apley
*Assistant Examiner*—Lynn A. Reichard
*Attorney, Agent, or Firm*—Bacon & Thomas

[57] ABSTRACT

A gripper device includes a handle and a tube pivotally coupled together, the handle is movable toward the tube for practising gripping exercise. Two discs are slidably engaged in the tube, and a spring is biased between the discs. One of the discs is coupled to the handle, and the other disc is threaded with a bolt which is rotatably engaged in the tube. The discs are moved relative to each other when the bolt is rotated such that the biasing force of the spring can be adjusted.

4 Claims, 4 Drawing Sheets

GRIPPER DEVICE

BACKGROUND OF THE INVENTION

1. Field of the Invention

The present invention relates to a gripper device, and more particularly to an adjustable gripping exercising device.

2. Description of the Prior Art

Typical gripper devices comprise a pair of handles coupled together by resilient members and movable together against the biasing force of the resilient members so as to practise gripping exercises. However, the resilient force of the resilient members can not be adjusted.

The present invention has arisen to mitigate and/or obviate the afore-described disadvantages of the conventional gripper devices.

SUMMARY OF THE INVENTION

The primary objective of the present invention is to provide a gripper device in which the resilient force can be adjusted.

In accordance with one aspect of the invention, there is provided a gripper device comprising a tube including a first end and a second end; a handle including a first end pivotally coupled to the first end of the tube; two discs slidably engaged in the tube; means for guiding the discs to move longitudinally in the tube; means biasing between the discs; a bolt rotatably engaged in the tube, engaged through a first of the discs and threadedly engaged with a second of the discs; cable means coupling the first disc to the first end of the handle; the first disc being moved against the biasing means when the handle is moved toward the tube, and the second disc being moved relative to the first disc when the bolt is rotated.

A bracket is pivotally coupled to the first end of the handle, and the cable means is coupled between the first disc and the bracket. A cap is engaged with the second end of the tube and fixed to the bolt such that the bolt and the cap rotating in concert with each other. The cap includes a plurality of depressions formed therein. The second end of the tube includes a cavity for receiving a catch, and a spring biases the catch to engage with either of the depressions of the cap so as to position the cap relative to the tube. The tube includes a window provided therein and located close to the second disc for viewing the second disc.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
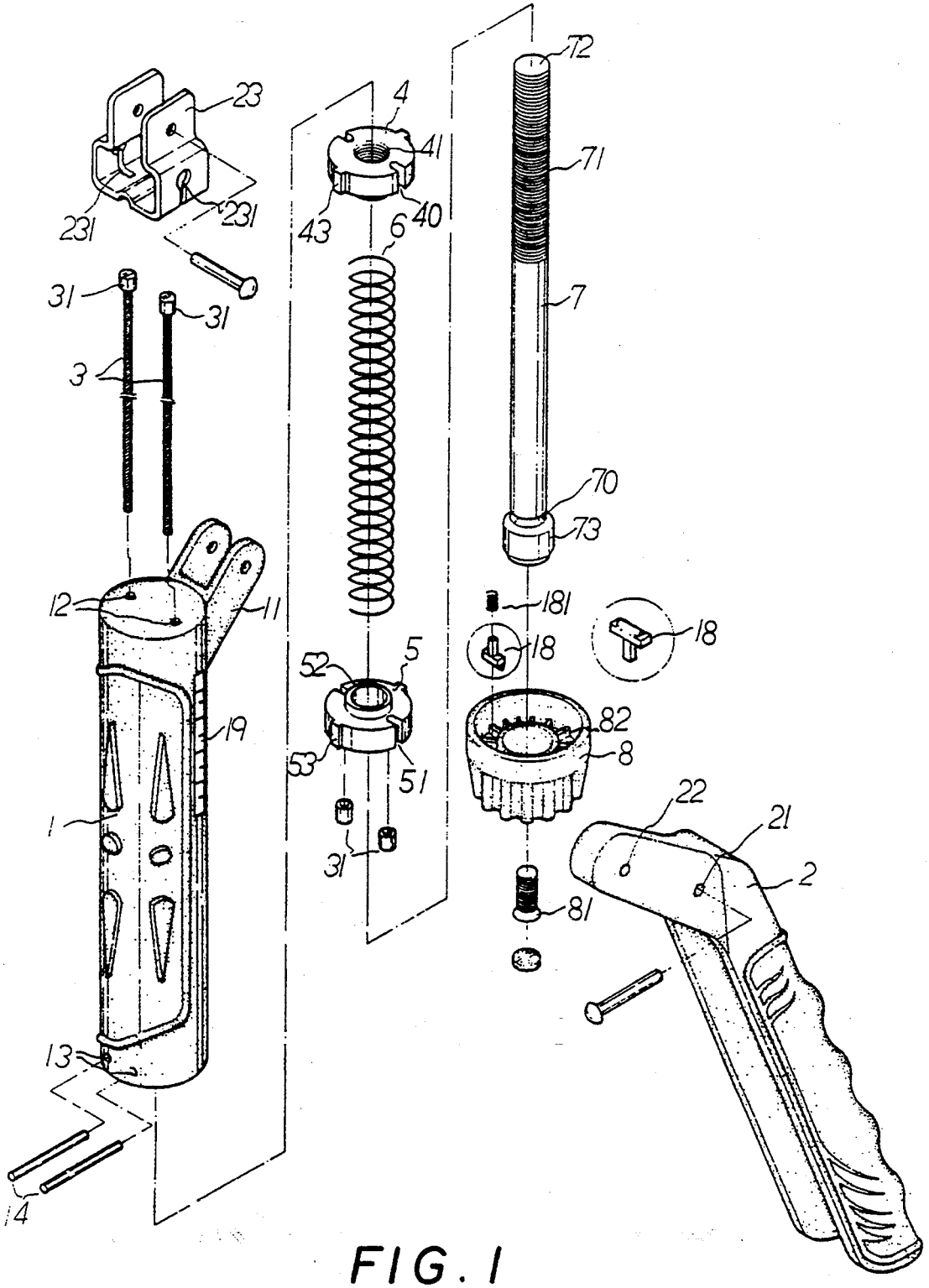
FIG. 1 is an exploded view of a gripper device in accordance with the present invention.
Figure 2:
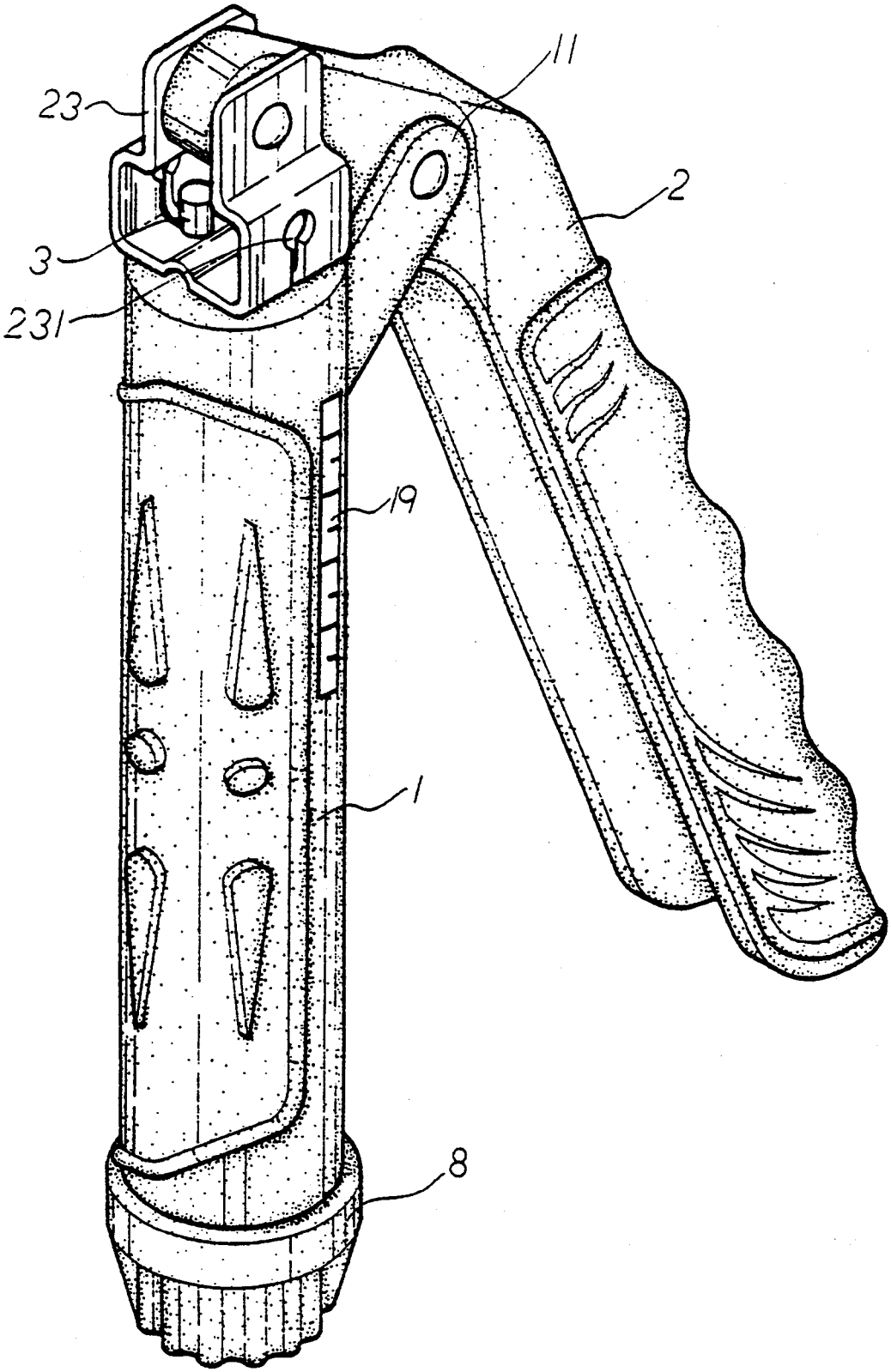
FIG. 2 is a perspective view of the gripper device.
Figure 3:
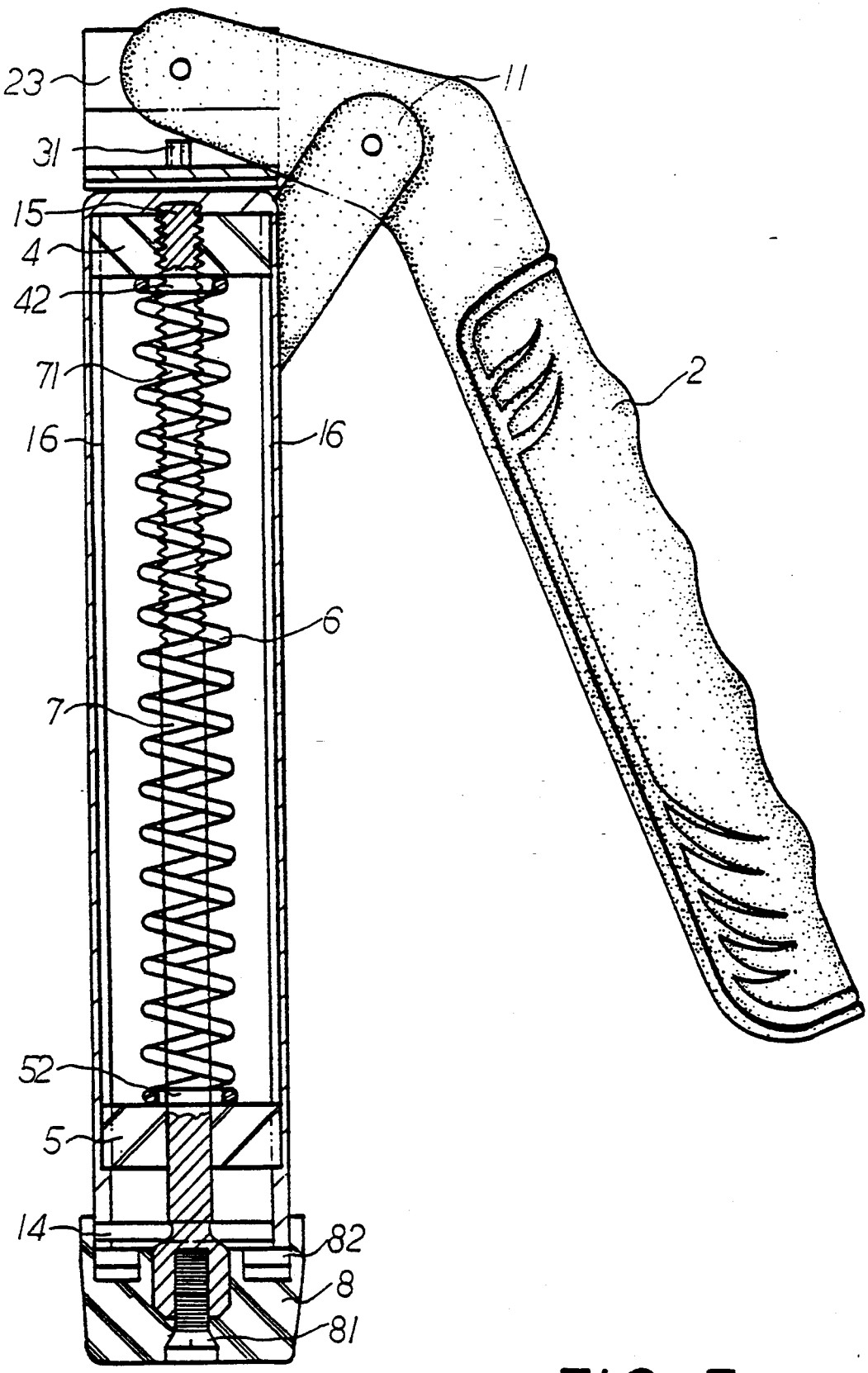
FIG. 3 is a cross sectional view of the gripper device.

Referring to the drawings, and initially to FIGS. 1 to 3, a gripper device in accordance with the present invention comprises a tube 1 including a pair of ears 11 extended therefrom, and a handle 2 including two holes 21, 22 formed therein for engaging with pin elements, in which the pin element engaged through the hole 21 is also engaged with the ears 11 of the tube 1 so as to pivotally couple the handle 2 to the tube 1, another pin element engaged through the other hole 22 is engaged with a bracket 23 so as to pivotally couple the bracket 23 to the handle 2. The bracket 23 includes two slots 231 formed therein for engaging with two cables 3. The tube 1 includes two holes 12 formed in the upper portion for engaging with the cables 3 and two holes 13 formed in the bottom portion for engaging with two pins 14. The tube 1 includes a pair of channels 16 longitudinally formed therein.

Two discs 4, 5 are slidably engaged in the tube 1 and each includes two lugs 43, 53 for engaging with the channels 16 of the tube 1 such that the discs 4, 5 are guided to move longitudinally within the tube 1 and can not rotate relative to the tube 1. The discs 4, 5 each includes two slots 40, 51 formed therein for engaging with the cables 3. The cables 3 each includes two heads 31 formed in the end portions for engaging with the bracket 23 and the disc 5, best shown in FIG. 4. A spring 6 is biased between the discs 4, 5 and engaged with the annular flanges 42, 52 of the discs. A bolt 7 is engaged through the center bore of the disc 5 and includes an outer thread 71 for engaging with the inner thread 41 of the disc 4, the bolt 7 has an upper end 72 engaging with the top end portion 15 of the tube best shown in FIGS. 3 to 5. The bolt 7 further includes a head 73 and an annular groove 70 formed in the bottom portion. The pins 14 are engaged with the annular groove 70 of the bolt 7 such that the bolt 7 is limited to rotational movement only and may not move up and down within the tube 1. A cap 8 is engaged on the bottom end of the tube 1 and engaged with the bolt head 73, the bolt head 73 is fixed to the cap 8 by a screw 81 such that the bolt 7 can be rotated by the cap 8. The disc 4 is caused to move up and down relative to the bolt 7 so as to adjust the biasing force of the spring 6 when the bolt 7 is rotated. A window 19 with a scale provided thereon is disposed in the upper portion of the tube 1, the position of the disc 4 relative to the scale of the window 19 indicates the biasing force of the gripper device.

Figure 4:
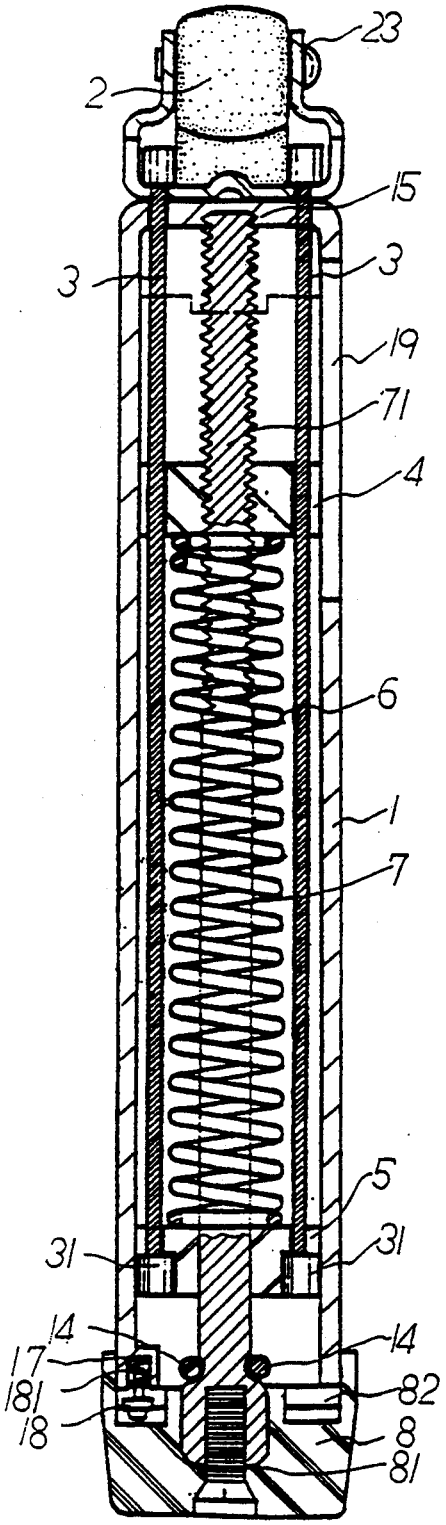
FIGS. 4 and 5 are cross sectional views illustrating the operation of the gripper device.

Referring next to FIGS. 1, 3 and 4, the cap 8 includes a number of depressions 82 formed in the inner peripheral portion. The bottom portion of the tube 1 includes a cavity 17 formed therein for receiving a spring 181 and a catch 18. The catch 18 is biased to engage with either of the depressions 82 of the cap 8 by the spring 181 so as to position the cap 8 relative to the tube 1.

Figure 5:
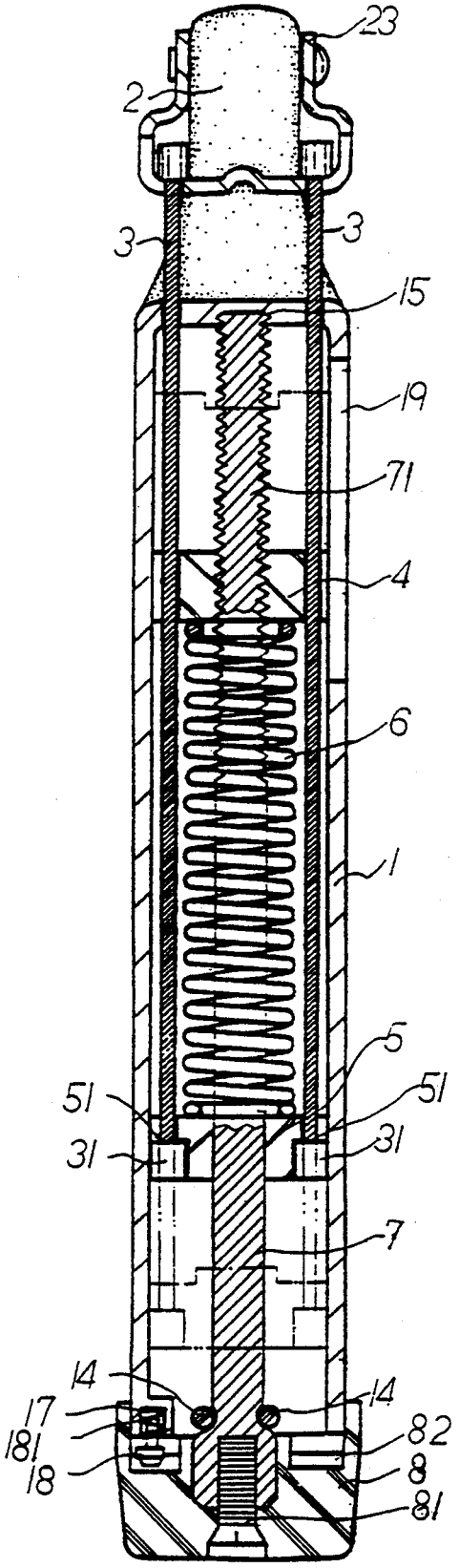

In operation, as shown in FIGS. 4 and 5, the bracket 23 can be moved upward by the handle 2 when the handle 2 is forced toward the tube 1, the disc 5 can thus be moved against the spring 6 by the cables 3 and the bracket 23.

Accordingly, the gripper device in accordance with the present invention includes a resilient force that can be easily adjusted according to the user's need.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A gripper device comprising:

a tube including a first end and a second end;

a handle including a first end pivotally coupled to said first end of said tube;

two discs slidably engaged in said tube;

means for guiding said discs to move longitudinally in said tube;

biasing means between said discs;

a bolt rotatably engaged in said tube, engaged through a first of said discs and threadedly engaged with a second of said discs;

cable means coupling said first disc to said first end of said handle;

said first disc being moved against said biasing means when said handle is moved toward said tube, and said second disc being moved relative to said first disc when said bolt is rotated.

2. A gripper device according to claim 1 further comprising a bracket pivotally coupled to said first end of said handle, said cable means being coupled between said first disc and said bracket.

3. A gripper device according to claim 1 further comprising a cap engaged with said second end of said tube, said bolt including a head secured to said cap such that said bolt and said cap rotate in concert with each other, said cap including a plurality of depressions formed therein, said second end of said tube including a cavity formed therein, a catch received in said cavity, and means for biasing said catch to engage with either of said depressions of said cap so as to position said cap relative to said tube.

4. A gripper device according to claim 1, wherein said tube includes a window provided therein and located close to said second disc for viewing said second disc.

* * * * *